US011179594B2

(12) United States Patent
Chen

(10) Patent No.: US 11,179,594 B2
(45) Date of Patent: Nov. 23, 2021

(54) ADJUSTABLE DUMBBELL

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 111 days.

(21) Appl. No.: 16/683,314

(22) Filed: Nov. 14, 2019

(65) Prior Publication Data

US 2021/0146186 A1 May 20, 2021

(51) Int. Cl.
*A63B 21/075* (2006.01)
*A63B 21/072* (2006.01)

(52) U.S. Cl.
CPC ..... *A63B 21/075* (2013.01); *A63B 21/0728* (2013.01); *A63B 21/072* (2013.01); *A63B 21/0724* (2013.01); *A63B 21/0726* (2013.01)

(58) Field of Classification Search
None
See application file for complete search history.

(56) References Cited

U.S. PATENT DOCUMENTS 5,407,413 A 4/1995 Kupferman
5,839,997 A 11/1998 Roth et al.
6,656,093 B2 12/2003 Chen
7,223,214 B2 5/2007 Chen
7,731,641 B1 6/2010 Chen
7,811,213 B2 10/2010 Chen
9,616,273 B2 4/2017 Chen
9,956,451 B1 * 5/2018 Wang ..... A63B 21/0728
10,343,010 B2 7/2019 Chen
10,843,027 B2 * 11/2020 Wang ..... A63B 21/0728
2010/0304939 A1 * 12/2010 Svenberg ..... A63B 21/072 482/108
2015/0360073 A1 * 12/2015 Moran ..... A63B 21/0726 482/107
2017/0239510 A1 * 8/2017 Wang ..... A63B 21/0726
2017/0252599 A1 * 9/2017 Wang ..... A63B 21/075
2018/0078810 A1 * 3/2018 Chen ..... A63B 21/075
2018/0169459 A1 * 6/2018 Wang ..... A63B 71/0619
2018/0353794 A1 * 12/2018 Wang ..... A63B 21/075

* cited by examiner

*Primary Examiner* — Joshua Lee
(74) *Attorney, Agent, or Firm* — Browdy and Neimark, PLLC

(57) ABSTRACT

An adjustable dumbbell device includes a handle bar, a housing attached to one end of the handle bar, one or more weight elements engageable into the housing, and a catch is slidably received and engaged in the housing and extendible out of the housing to engage with either the weight elements and to anchor either of the weight elements to the housing and the handle bar and for micro adjusting the weight of the dumbbell assembly. The housing includes a guide channel for slidably receiving the catch. The housing includes a chamber communicating with the guide channel of the housing for receiving and engaging with the weight elements.

6 Claims, 6 Drawing Sheets

ADJUSTABLE DUMBBELL

BACKGROUND OF THE INVENTION

1. Field of the Invention

The present invention relates to an adjustable dumbbell, and more particularly to an adjustable dumbbell assembly having an easily and quickly adjustable structure for micro adjusting the weight of the dumbbell assembly, and having a relatively decreased weight for the adjustable dumbbell assembly.

2. Description of the Prior Art

Various kinds of typical adjustable dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, and U.S. Pat. No. 9,616,273 to Chen, disclose several of the typical adjustable dumbbells each including a number of weight rings that may be selectively or adjustably secured together for adjusting the weight of the dumbbells.

Normally, in the typical adjustable dumbbells, two extension carriers or tracks are formed or provided on the end portions or extended outwardly from the end portions of the central handle bar, and the weight rings may be selectively or adjustably secured to the extension carriers or tracks.

However, the extension carriers or tracks are required to be permanently formed or provided on the end portions of the central handle bar such that the extension carriers or tracks and the central handle bar may form and may include a greatly increased length for the typical adjustable dumbbells.

In addition, the handle of the typical adjustable dumbbells may not be used for attaching or detaching the other weight rings or weight members.

U.S. Pat. No. 10,343,010 to Chen discloses another typical adjustable dumbbell also including a number of weight rings that may be selectively or adjustably secured together for adjusting the weight of the dumbbells, and further including a structure for adjusting to different weights and for micro adjusting the weight of the dumbbell assembly.

However, the actuating or controlling device is required to be pivoted or rotated relative to the base and the weight members and may not be easily and quickly adjusted or actuated or operated by the users.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including a structure that may be easily and quickly adjusted to different weights and that include the other weight rings or weight members attachable to a handle device thereof for micro adjusting the weight of the dumbbell assembly.

The other objective of the present invention is to provide an adjustable dumbbell assembly including a structure having no extension carriers or tracks formed or provided on the end portions or extended outwardly from the end portions of the central handle bar such that the total length of the dumbbell assembly may be selectively decreased.

In accordance with one aspect of the invention, there is provided an adjustable dumbbell assembly comprising a handle bar including a first end and a second end, a housing attached to the first end of the handle bar, a first weight element and a second weight element engageable to the housing, a catch slidably received and engaged in the housing and extendible out of the housing to engage with either the first or the second weight element and to anchor either the first or the second weight element to the housing and the handle bar selectively and for allowing the weight of the dumbbell assembly to be micro adjusted.

The housing includes a guide channel formed therein for slidably receiving and engaging with the catch. The housing includes a chamber formed in the housing and communicating with the guide channel of the housing for receiving and engaging with the first and the second weight elements and for allowing the first and the second weight elements to be detachably attached or anchored to the housing.

The first weight element includes at least one aperture formed in the first weight element for engaging with the catch. The first weight element includes a compartment formed in the first weight element for receiving and engaging with the second weight element, and the first weight element includes at least one arm having the aperture formed in the arm for selectively receiving or engaging with the catch.

The second weight element includes at least one orifice formed in the second weight element for engaging with the catch. The second weight element includes a space formed in the second weight element, and the second weight element includes at least one limb having the orifice formed in the limb for selectively receiving or engaging with the catch.

One or more weight members may further be provided, and a latch is slidably engaged with the handle bar for detachably securing either of the weight members to the handle bar and for allowing the weight members and the weight elements of the required or selected or predetermined number to be selectively adjusted and attached or mounted or secured to the housing and the handle bar.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
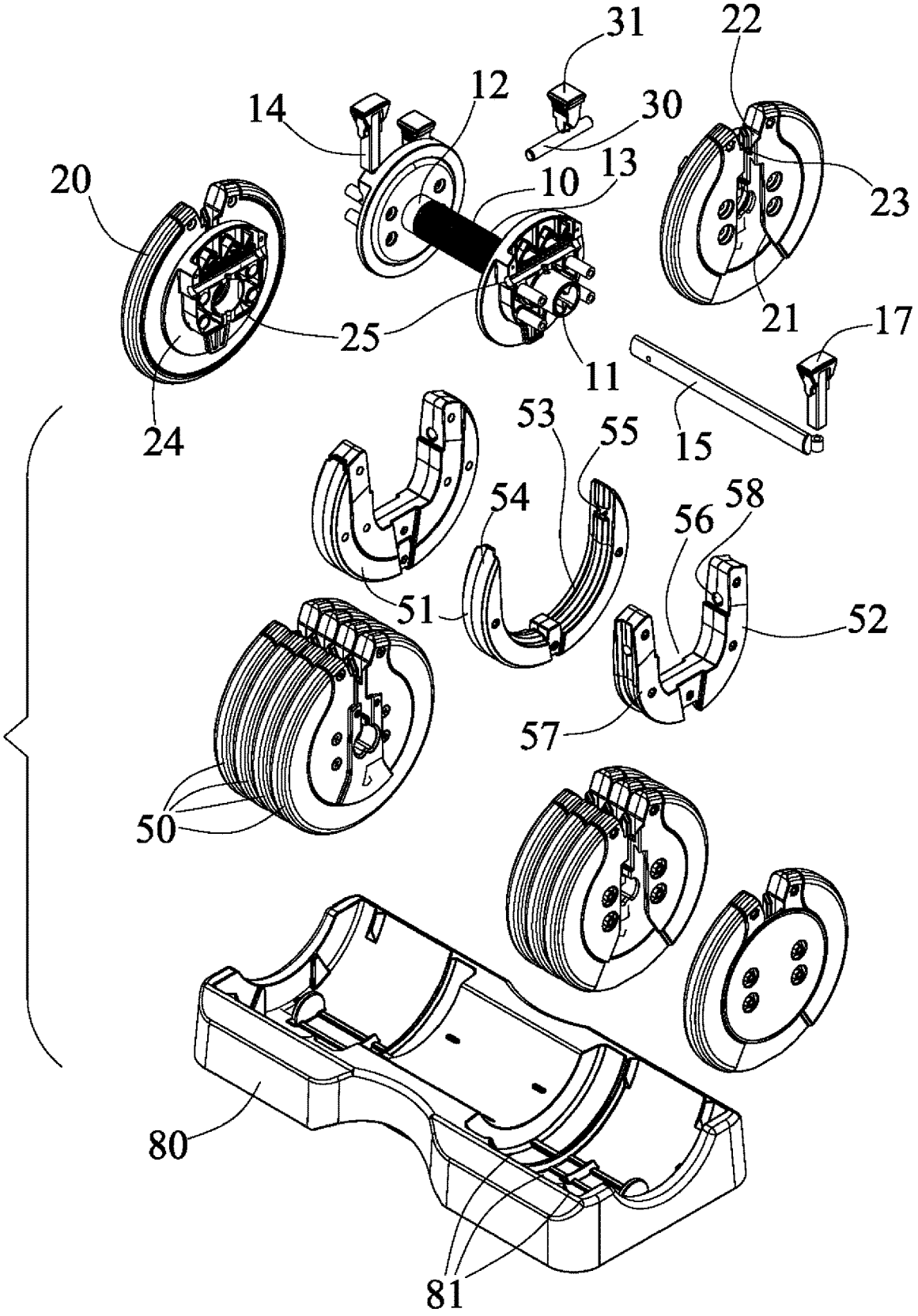
FIG. 1 is a partial exploded view of an adjustable dumbbell assembly in accordance with the present invention.
Figure 2:
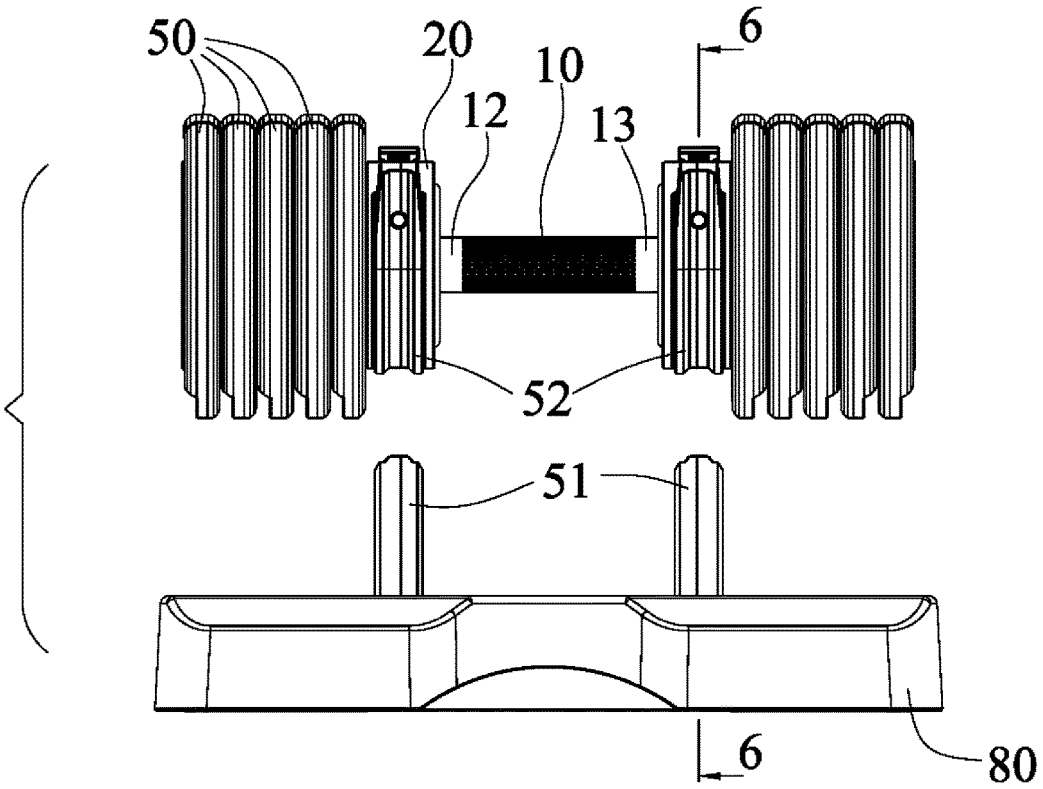
FIG. 2 is a front plan schematic and partial exploded view of the adjustable dumbbell assembly.
Figure 3:
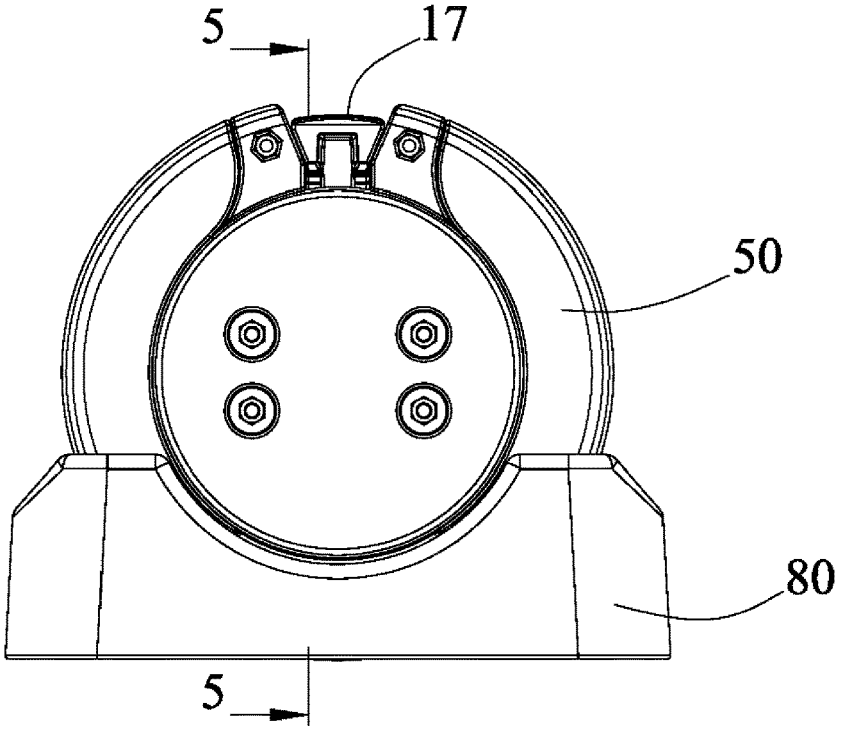
FIG. 3 is an end plan schematic view of the adjustable dumbbell assembly.
Figure 4:
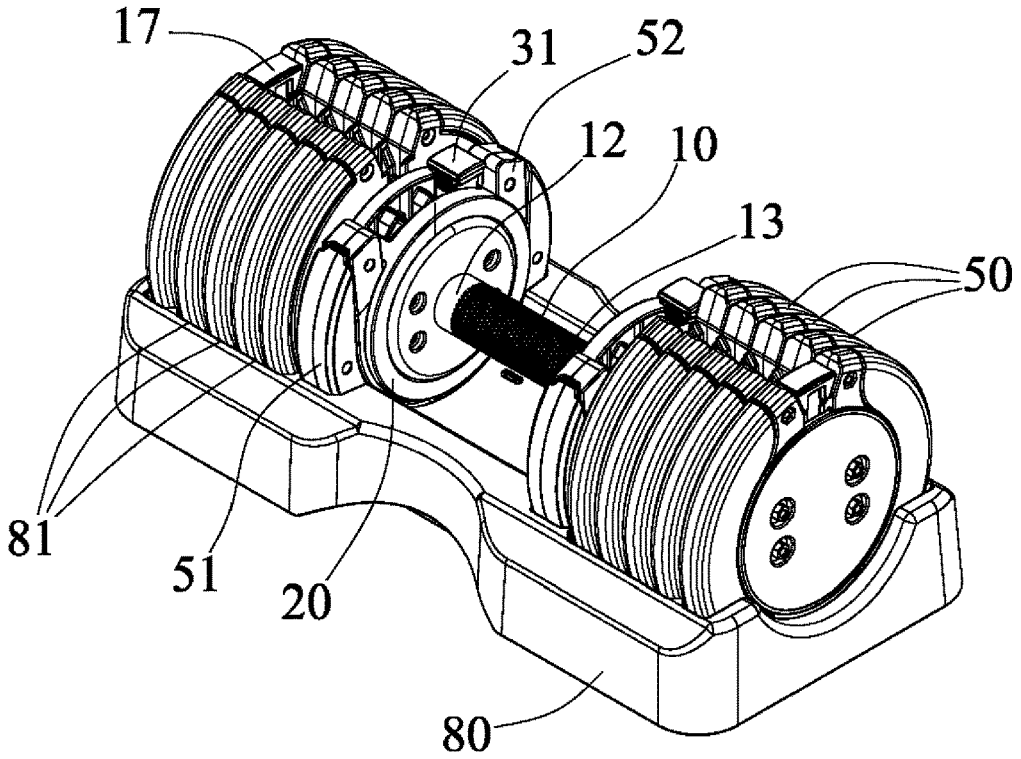
FIG. 4 is an upper perspective of the adjustable dumbbell assembly.
Figure 5:
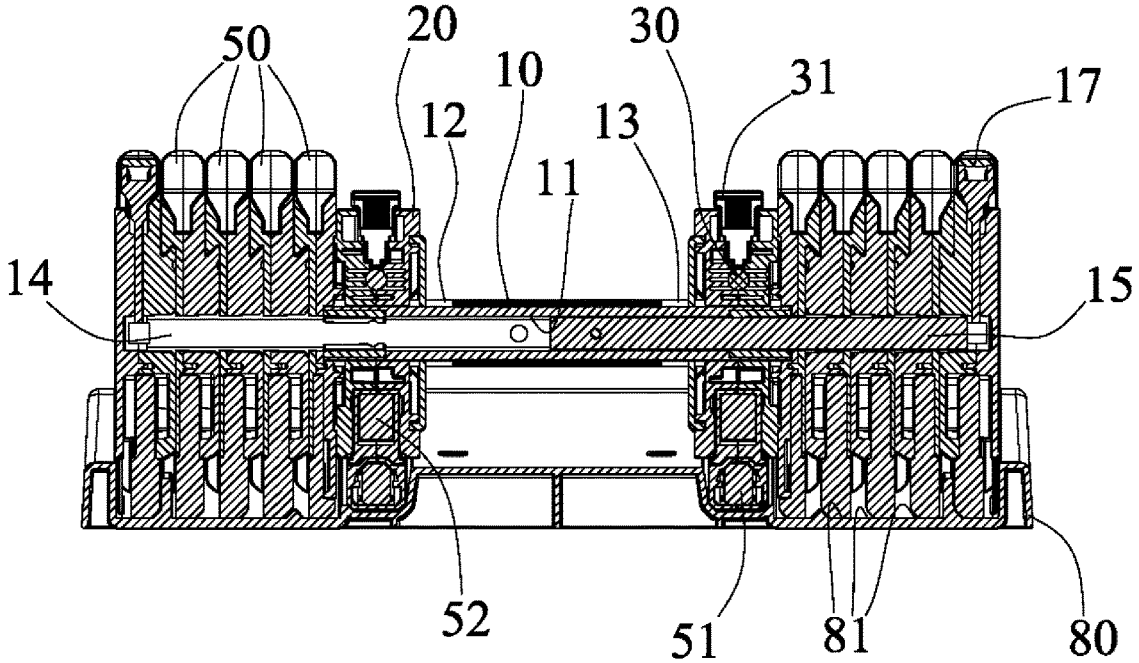
FIG. 5 is a cross sectional view of the adjustable dumbbell assembly, taken along lines 5-5 of FIG. 3.

Referring to the drawings, and initially to FIGS. 1-5, an adjustable dumbbell assembly in accordance with the present invention comprises a central handle bar 10, and a number of weights 50, such as weight rings or plates or members 50 to be selectively or adjustably secured to the central handle bar 10, and to be easily and quickly adjusted to different weights for the adjustable dumbbell assembly. As shown in FIGS. 1 and 5, the handle bar 10 includes an elongated or longitudinal hole or bore 11 formed therein, and includes one or more (such as two) end portions 12, 13 each having a plate or housing 20 extended radially and outwardly therefrom, the bore 11 of the handle bar 10 also formed through the housings 20, and the housings 20 each include a slot 21, such as a dovetail slot 21 formed therein (FIG. 1), and communicating with the bore 11 of the handle bar 10.

The housings 20 each further include a cavity 22 formed therein, such as formed in the upper portion thereof and also communicating with the bore 11 of the handle bar 10, and each further include a shoulder or seat 23 formed or provided in the housing 20 and communicating with or located beside the cavity 22 of the housing 20 or of the handle bar 10. One or more (such as two) rods or latches 14, 15 (FIGS. 1 and 5) are slidably engaged in the bore 11 of the handle bar 10 and extendible out of the housing 20 and the end portions 12, 13 of the handle bar 10, for detachably or changeably or removably and/or adjustably attaching or mounting or securing the required or predetermined number of the weight members 50 to the housing 20 or the end portions 12, 13 of the handle bar 10. The attachment of the weight members 50 to the housing 20 or the end portions 12, 13 of the handle bar 10 with the latches 14, 15 is not related to the present invention and will not be described in further details. A base or receptacle 80 may further be provided and includes a number of recesses or depressions or socket openings 81 formed therein for selectively receiving or engaging with the weight members 50 and/or the housings 20.

A spring biased knob 17 is attached or mounted to each of the latches 14, 15 for selectively engaging with the cavity 22 of the housing 20 or of the handle bar 10, and/or for selectively engaging with the seat 23 of the housing 20 or of the handle bar 10, and for selectively anchoring or retaining or positioning the knob 17 and thus the latches 14, 15 to the housings 20 and the handle bar 10, and thus for preventing the knob 17 and the latches 14, 15 from moving or sliding relative to the handle bar 10. Similarly, the engagement of the latches 14, 15 with the weight members 50 is also not related to the present invention and will not be described in further details. The housings 20 each include a U-shaped or peripheral compartment or chamber 24 formed therein for selectively and slidably receiving or engaging with one or more (such as two) weight elements 51, 52 which also include a U-shaped structure or configuration for selectively and detachably or changeably engaging with the corresponding U-shaped chamber 24 of the housing 20.

For example, as shown in FIGS. 1 and 6-8, the larger or first weight element 51 includes a space or compartment 53 formed therein for selectively receiving or engaging with the smaller or second weight element 52 and for forming or defining two limbs or arms 54 each having an aperture 55 formed therein, and the smaller or second weight element 52 also includes a compartment or space 56 formed therein for forming or defining two arms or limbs 57 each having an orifice 58 formed therein and aligned with the aperture 55 of the respective arm 54 of the larger or first weight element 51. The housings 20 each further include a guide channel 25 formed therein and communicating with the chamber 24 of the housing 20 for slidably receiving or engaging with a catch 30, and a knob or button or handgrip 31 is attached or mounted or secured or coupled to the catch 30 for moving or sliding the catch 30 to engage with the arms 54 and/or the limbs 57 of the weight elements 51, 52 selectively and for selectively and detachably or changeably anchoring or retaining or positioning the weight elements 51, 52 to the housing 20 and the handle bar 10.

Figure 6:
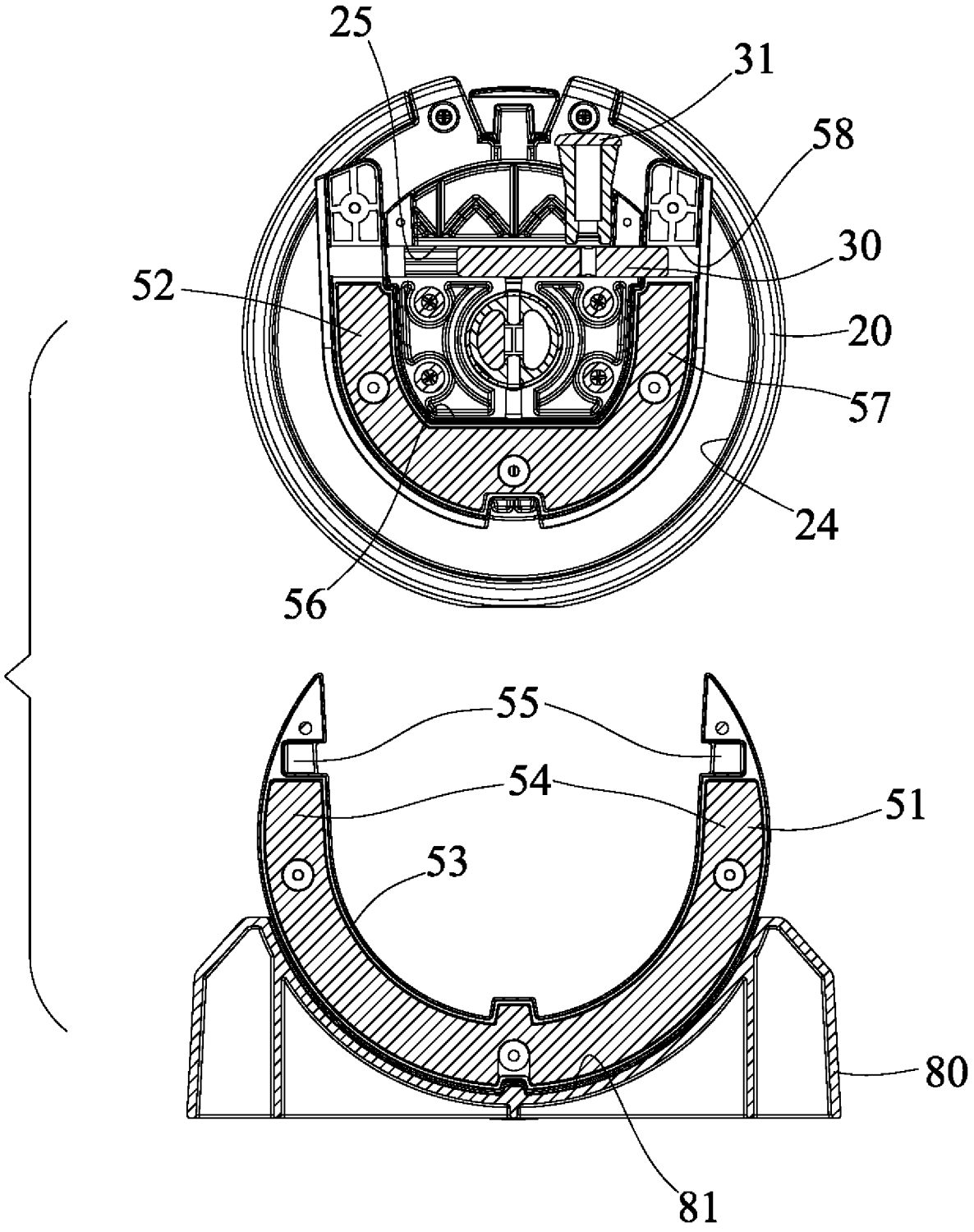
FIG. 6 is a partial exploded and cross sectional view of the adjustable dumbbell assembly, taken along lines 6-6 of FIG. 2.
Figure 8:
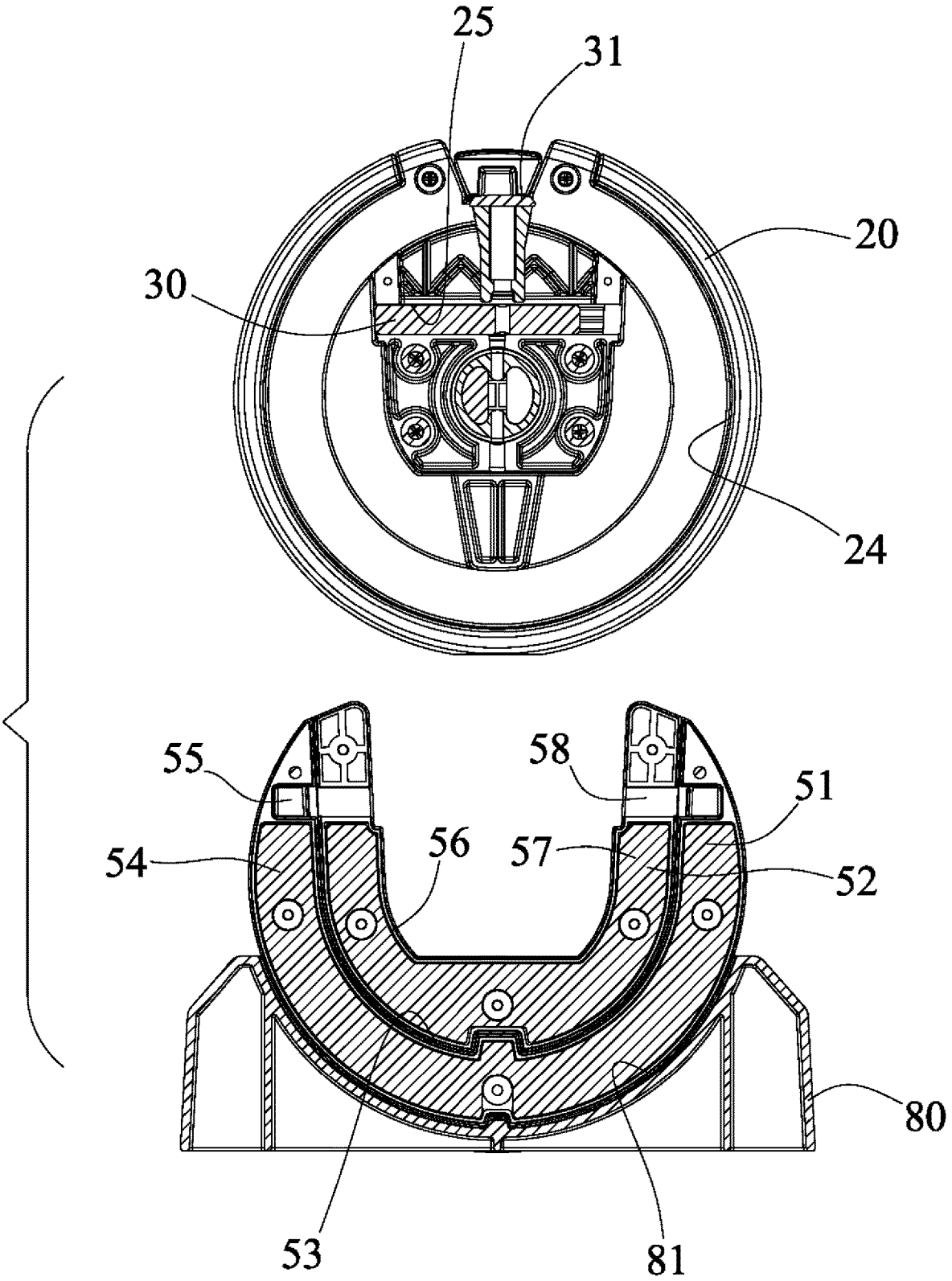

In operation, as shown in FIG. 8, when the catch 30 is engaged or received within the guide channel 25 of the housing 20 and when the catch 30 is not extended out of the housing 20, the catch 30 will not be engaged with the arms 54 and/or the limbs 57 of the weight elements 51, 52, such that the weight elements 51, 52 will not be anchored or retained or secured to the housing 20 and will be disengaged or separated from the housing 20. As shown in FIG. 6, when the catch 30 is moved and extended out of the housing 20 in one direction, such as rightwardly to engage with either of the orifices 58 of the limbs 57 of the second weight element 52, the second weight element 52 may be anchored or retained or secured to the housing 20 and will be moved and disengaged or separated from the first weight element 51 selectively.

Figure 7:
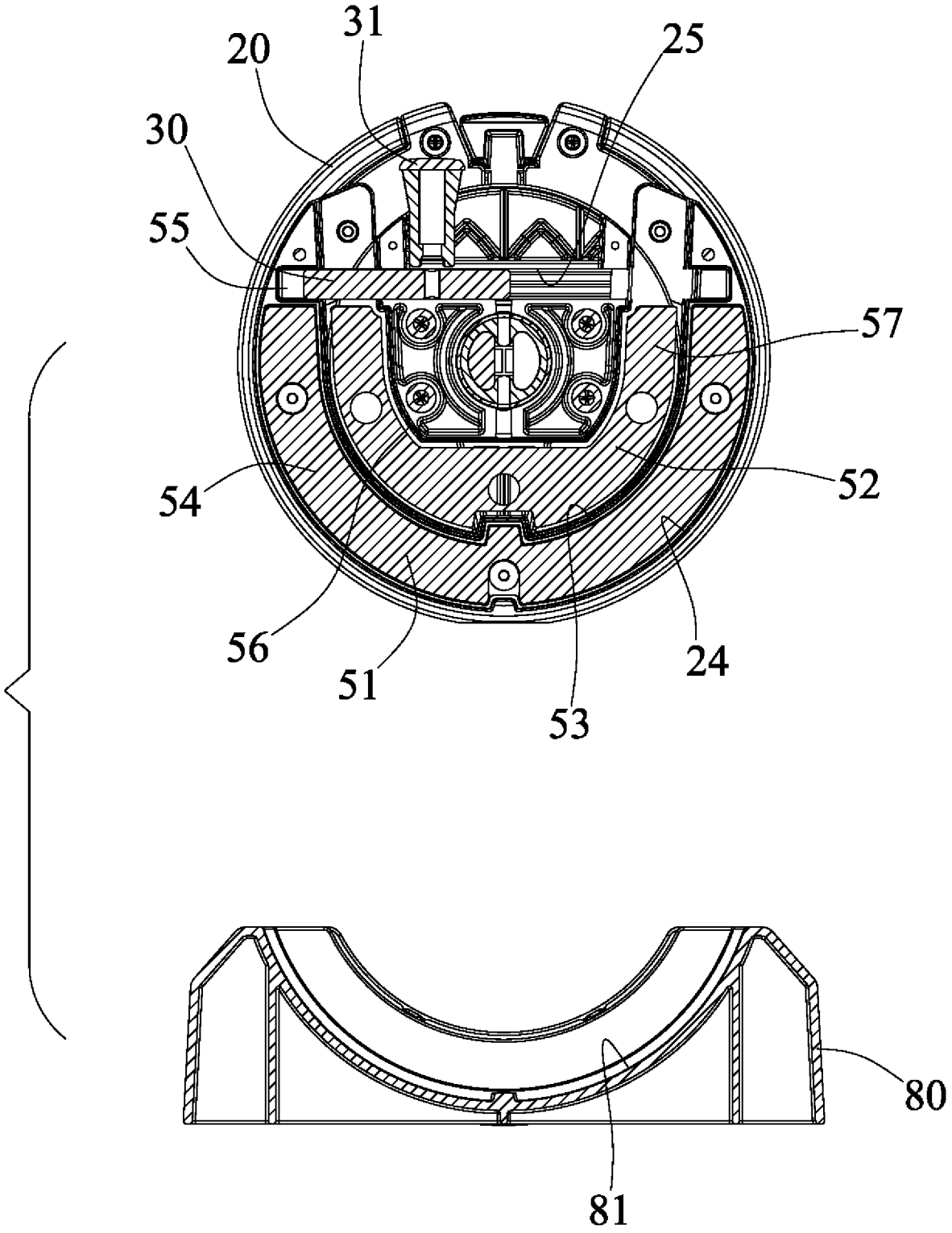
FIGS. 7 and 8 are partial exploded and cross sectional views similar to FIG. 6, illustrating the operation of the adjustable dumbbell assembly.

As shown in FIG. 7, when the catch 30 is moved leftwardly or out of the housing 20 to engage with either of the apertures 55 of the arms 54 of the first weight element 51, both the first and the second weight elements 51, 52 will be anchored or retained or secured to the housing 20 and will be moved and disengaged or separated from the receptacle 80 selectively, and thus for selectively and detachably or changeably or removably anchoring or retaining or positioning the weight elements 51, 52 to the housing 20 and the handle bar 10.

In operation, as shown in FIGS. 4 and 5, the knob 17 may move and actuate the latches 14, 15 to engage with the required or selected or predetermined number of the weight members 50 for changeably or removably and/or adjustably attaching or mounting or securing the required or selected or predetermined number of the weight members 50 to the housing 20 or the end portions 12, 13 of the handle bar 10. As shown in FIGS. 6-8, the catch 30 may be moved to engage with the orifices 58 of the limbs 57 of the second weight element 52 and/or the apertures 55 of the arms 54 of the first weight element 51, so as to changeably or removably and/or adjustably attach or mount or secure the required or selected or predetermined number of the weight members 50 and/or the weight elements 51, 52 to the housing 20 or the end portions 12, 13 of the handle bar 10. It is to be noted that the weight elements 51, 52 include a weight smaller than that of the weight members 50 for allowing the total weight of the weight members 50 and/or the weight elements 51, 52 to be micro adjusted.

Accordingly, the adjustable dumbbell assembly in accordance with the present invention includes a structure that may be easily and quickly adjusted to different weights for micro adjusting the weight of the dumbbell assembly, and having no extension carriers or tracks formed or provided on the end portions or extended outwardly from the end portions of the central handle bar such that the total length of the dumbbell assembly may be selectively decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a handle bar including a first end and a second end, a housing attached to said first end of said handle bar, a first weight element and a second weight element engageable to said housing, and a catch slidably received and engaged in said housing and extendible out of said housing to engage with either said first or said second weight element and to anchor either said first or said second weight element to said housing and said handle bar selectively, wherein said first weight element includes at least one aperture formed in said first weight element for engaging with said catch, said first weight element includes a compartment formed in said first weight element for receiving and engaging with said second weight element, and said first weight element includes at least one arm having said at least one aperture formed in said at least one arm.

2. The adjustable dumbbell assembly as claimed in claim 1, wherein said housing includes a guide channel formed therein for slidably receiving and engaging with said catch.

3. The adjustable dumbbell assembly as claimed in claim 2, wherein said housing includes a chamber formed in said housing and communicating with said guide channel of said housing for receiving and engaging with said first and said second weight elements.

4. The adjustable dumbbell assembly as claimed in claim 1, wherein said second weight element includes at least one orifice formed in said second weight element for engaging with said catch.

5. The adjustable dumbbell assembly as claimed in claim 4, wherein said second weight element includes a space formed in said second weight element, and said second weight element includes at least one limb having said at least one orifice formed in said at least one limb.

6. The adjustable dumbbell assembly as claimed in claim 1 further comprising a weight member, and a latch slidably engaged with said handle bar for detachably securing said weight member to said handle bar.

* * * * *